US009962027B2

(12) United States Patent
Amrine et al.

(10) Patent No.: US 9,962,027 B2
(45) Date of Patent: May 8, 2018

(54) OPTIMIZED CHAIR MAT SHAPE

(71) Applicant: Dimex Office Products LLC, Marietta, OH (US)

(72) Inventors: Patrick Amrine, Williamstown, WV (US); Kevin Morey, Marietta, OH (US); Forrest Adam Sanders, Marietta, OH (US)

(73) Assignee: Dimex Office Products LLC, Marietta, OH (US)

( * ) Notice: Subject to any disclaimer, the term of this patent is extended or adjusted under 35 U.S.C. 154(b) by 32 days.

(21) Appl. No.: 15/333,649

(22) Filed: Oct. 25, 2016

(65) Prior Publication Data

US 2017/0318997 A1 Nov. 9, 2017

Related U.S. Application Data

(60) Provisional application No. 62/331,707, filed on May 4, 2016.

(51) Int. Cl.
*B32B 3/02* (2006.01)
*A47G 27/02* (2006.01)

(52) U.S. Cl.
CPC ..... *A47G 27/0206* (2013.01)

(58) Field of Classification Search
CPC ..... B32B 3/02; A47C 7/62
USPC ..... 428/80
See application file for complete search history.

(56) References Cited

U.S. PATENT DOCUMENTS

| | | | |
|---|---|---|---|
| D203,962 | S | 3/1966 | Taylor |
| 3,323,151 | A | 6/1967 | Lerman |
| 3,333,805 | A | 8/1967 | Marshall |
| 3,427,705 | A | 2/1969 | Campbell |
| D221,400 | S | 8/1971 | O'Donnell |
| 4,415,946 | A | 11/1983 | Pitts |
| D272,877 | S | 3/1984 | Yamamoto et al. |
| 4,472,471 | A | 9/1984 | Klein et al. |
| 4,784,888 | A | 11/1988 | Schwertner et al. |
| 4,921,563 | A | 5/1990 | Schwertner et al. |
| 4,940,620 | A | 7/1990 | Silk et al. |
| 5,022,844 | A | 6/1991 | Schwertner et al. |
| 5,073,428 | A | 12/1991 | Lancelot et al. |
| D330,988 | S | 11/1992 | Robbins, III |
| 6,177,165 | B1 | 1/2001 | Robbins, III et al. |
| 6,183,833 | B1 | 2/2001 | Robbins, III et al. |
| 6,284,341 | B1 | 9/2001 | Robbins, III et al. |
| 6,287,659 | B1 | 9/2001 | Robbins, III et al. |
| 6,554,782 | B2 | 4/2003 | Robbins, III et al. |
| 6,579,250 | B2 | 6/2003 | Robbins, III et al. |
| D477,172 | S | 7/2003 | Montague |
| 6,946,184 | B2 | 9/2005 | Robbins, III |
| 7,029,743 | B2 | 4/2006 | Robbins, III |

(Continued)

*Primary Examiner* — Alexander Thomas
(74) *Attorney, Agent, or Firm* — Wood Herron & Evans LLP

(57) ABSTRACT

A chair mat including a body having a perimeter. The perimeter is defined by a rear linear portion disposed opposite an arcuate lip portion, left and right rear arcuate portions separated by the rear linear portion, a left front arcuate portion separated from the left rear arcuate portion by a left linear portion, a right front arcuate portion separated from the right rear arcuate portion by a right linear portion, a left arcuate inwardly projecting portion separating the left front arcuate portion and the arcuate lip portion, and a right arcuate inwardly projecting portion separating the right front arcuate portion and the arcuate lip portion.

17 Claims, 3 Drawing Sheets

(56) References Cited

U.S. PATENT DOCUMENTS

| | | | |
|---|---|---|---|
| D522,299 | S | 6/2006 | Robbins, III |
| 8,075,971 | B1 | 12/2011 | Horian |

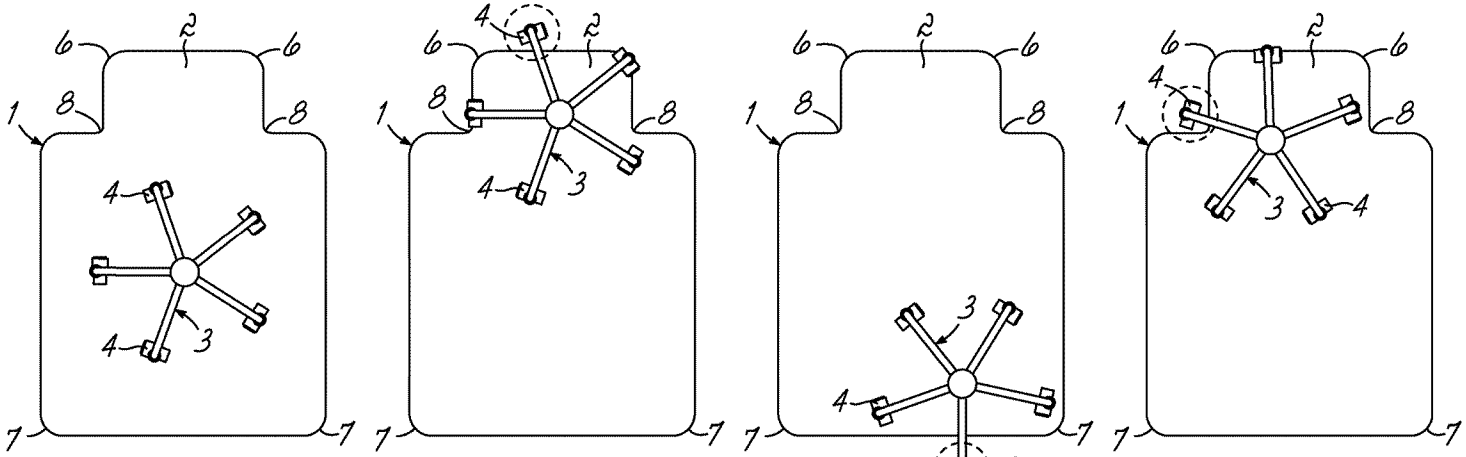
FIG. 1A
PRIOR ART
FIG. 1B
PRIOR ART
FIG. 1C
PRIOR ART
FIG. 1D
PRIOR ART
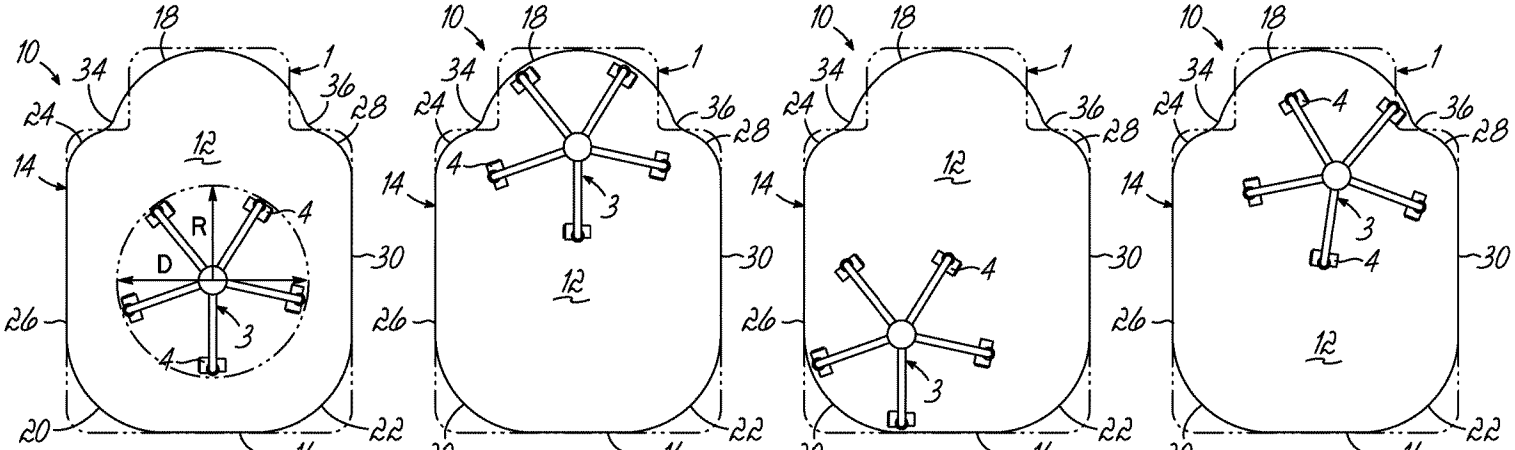
FIG. 2A
FIG. 2B
FIG. 2C
FIG. 2D

OPTIMIZED CHAIR MAT SHAPE

CROSS REFERENCE TO RELATED APPLICATION

This application claims the priority of U.S. Provisional Patent Application Ser. No. 62/331,707, filed on May 4, 2016, the entire disclosure of which is hereby incorporated by reference herein.

TECHNICAL FIELD

This invention generally relates to chair mats and, more particularly, to an optimized chair mat shape.

BACKGROUND OF THE INVENTION

Chair mats designed for use with office chairs are well known. Chair mats were introduced in the 1960's with the familiar rectangular lip projection becoming the industry standard. The rectangular lip projection is designed to extend floor protection for the center region of the popular Steelcase and pedestal desks, which feature compact leg room flanked by drawers on either side. However, around this time, traditional desks were incorporating a single leg support centered under the drawers, thereby eliminating the need for a rectangular lip projection. Today, the majority of desks and tables in use and being sold (for both commercial and residential applications), no longer require the rectangular lip projection to extend under the desk. Similar to desks, chairs have also evolved over the last half century, transitioning from the traditional four wheel bases of the 1960's and 1970's (having a square footprint when viewed from above) to today's five wheel bases (having circular footprint when viewed from above).

FIGS. 1A-1D show a prior art chair mat 1 having a rectangular lip portion 2, where a base 3 of an office chair is shown in various positions relative to the prior art mat 1. The base 3 includes five wheels 4. As shown in FIG. 1A, the development of the base 3 makes traditional shapes of prior art chair mats 1 ineffective with the circular footprint of the wheels 5. Likewise, as shown in FIG. 1B, the rectangular lip portion 2 possesses front corners 6 that are seldom used, resulting in inefficiencies and wasted material. Additionally, as the wheels 4 roll to one of these front corners 6, one or more of the wheels 4 may have already slid off of the prior art chair mat 1 as shown in FIG. 1B. Moreover, the rear corners 7 of the prior art chair mat 1 cannot accommodate the circular footprint of the base 3, resulting in one of the wheels 4 sliding off the prior art chair mat 1 as shown in FIG. 1C. Another problem with the prior art chair mat 1 is that the inside corners 8 between the rectangular lip portion 2 and the remainder of the prior art chair mat 1 allow the wheels 4 to get stuck, thereby inhibiting free motion of the base 3 of the office chair as shown in FIG. 1D.

Accordingly, there is a need for an optimized chair mat shape that eliminates these problems, while making more efficient use of the surface area of the chair mat.

SUMMARY OF THE INVENTION

In accordance with the various embodiments, the chair mat includes a body having a perimeter. The perimeter is defined by a rear linear portion, an arcuate lip portion, left and right front arcuate portions, left and right linear portions, and left and right arcuate inwardly projecting portions. The rear linear portion is disposed opposite an arcuate lip portion. The left and right rear arcuate portions are separated by the rear linear portion. The left front arcuate portion is separated from the left rear arcuate portion by a left linear portion. The right front arcuate portion is separated from the right rear arcuate portion by the right linear portion. The left arcuate inwardly projecting portion separates the left front arcuate portion and the arcuate lip portion. The right arcuate inwardly projecting portion separates the right front arcuate portion and the arcuate lip portion. The left and right arcuate inwardly projecting portions each have an internal radius of between about 6 inches and about 18 inches.

Additional details and advantages of the optimized chair mat shape and associated methods of manufacture will become more apparent upon review of the following detailed description taken in conjunction with the accompanying drawings.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein:

FIG. 1A is a schematic top view of a prior art chair mat with a chair having a five wheel base being positioned in the center of the prior art chair mat;

FIG. 1B is a schematic top view of the prior art chair mat of FIG. 1A, but with one wheel of the base extending beyond the rectangular lip portion;

FIG. 1C is a schematic top view of the prior art chair mat of FIG. 1A, but with one wheel of the base extending beyond the rear portion of the prior art chair mat;

FIG. 1D is a schematic top view of the prior art chair mat of FIG. 1A, but with one wheel of the base extending beyond the rectangular lip portion;

FIG. 2A is a schematic top view of a chair mat according to an exemplary embodiment, where a chair having a five wheel base is positioned in the center of the chair mat, with the prior art chair mat being shown in phantom lines;

FIG. 2B is a schematic top view of the chair mat of FIG. 2A, but with two wheels of the base being located near the edge of the front lip projection;

FIG. 2C is a schematic top view of the chair mat of FIG. 2A, but with two wheels of the base being located adjacent the left rear arcuate portion;

FIG. 2D is a schematic top view of the chair mat of FIG. 2A, but with two wheels of the base being located near the edge of the front lip projection;

DETAILED DESCRIPTION

Figure 3:
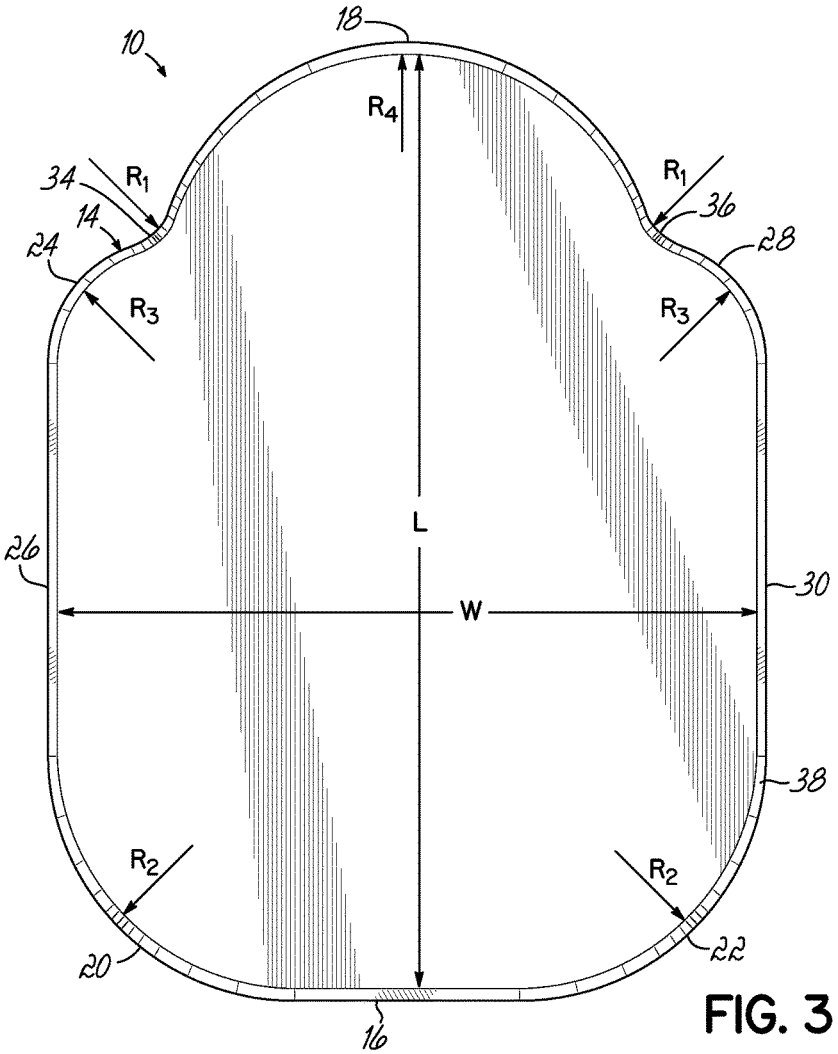
FIG. 3 is a top view of the chair mat of FIGS. 2A-2D.
Figure 4:
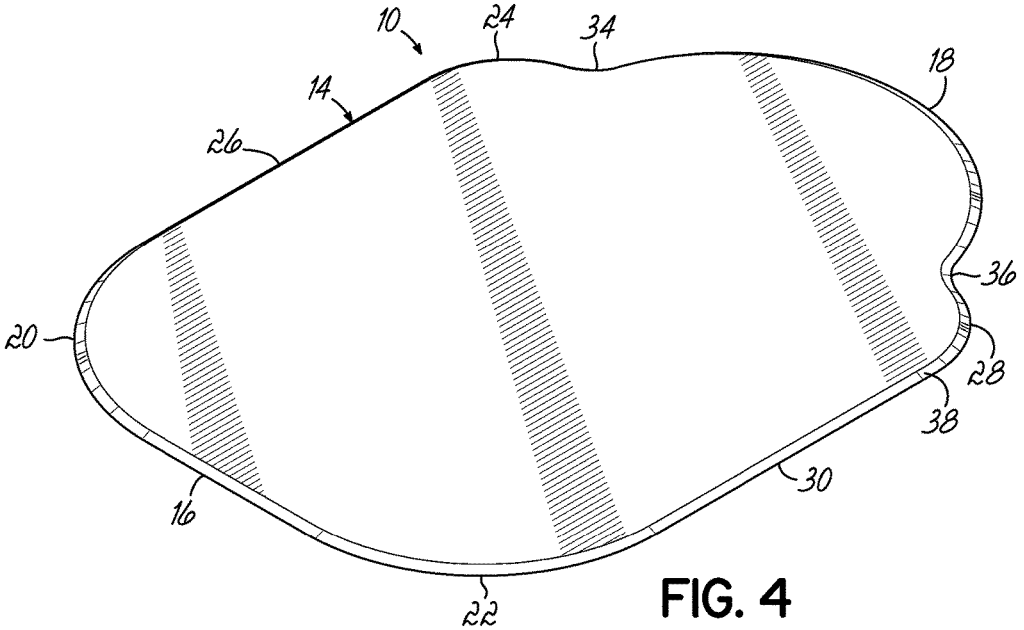
FIG. 4 is a perspective view of the chair mat of FIG. 3.

Referring now to the drawings, and to FIGS. 3 and 4 in particular, the chair mat 10 includes a body 12 having a perimeter 14. As shown, the perimeter 14 is defined by a rear linear portion 16, an arcuate lip portion 18, a left rear arcuate portion 20, a right rear arcuate portion 22, a left front arcuate portion 24, a left linear portion 26, a right front arcuate portion 28, a right linear portion 30, a left arcuate inwardly projecting portion 34, and a right arcuate inwardly projecting portion 36. The function, benefits, and structure of the various features are described in turn below in connection with the respective Figures, where similar reference numerals refer to similar features.

As shown most clearly in the top view of FIG. 3, the rear linear portion 16 is disposed opposite an arcuate lip portion 18. The left and right rear arcuate portions 20, 22 are separated by the rear linear portion 16. The left front arcuate portion 24 is separated from the left rear arcuate portion 20 by the left linear portion 26. The right front arcuate portion 28 is separated from the right rear arcuate portion 22 by the right linear portion 30. The left arcuate inwardly projecting portion 34 separates the left front arcuate portion 24 and the arcuate lip portion 18, and the right arcuate inwardly projecting portion 36 separates the right front arcuate portion 28 and the arcuate lip portion 18. Additionally, the chair mat 10 includes a contoured edge 38.

While the chair mat 10 shown in FIG. 3 is generally about 36 inches wide W by about 48 inches long L (inclusive of the arcuate lip portion 18), these dimensions are merely for illustrative purposes. Persons skilled in the art would appreciate that the chair mat 10 may vary in length and/or in width. Additionally, various chair mats are shown and described in U.S. Design application Ser. No. 29/560,123 filed Apr. 4, 2016, the disclosure of which is incorporated by reference herein in its entirety. Further, the body 12 may include one or more layers and may be made, for example, from a polyvinyl chloride material, a polycarbonate material, or any other suitable material.

Referring now FIGS. 2A-2D, a chair mat 10 according to an exemplary embodiment is shown in solid lines, with the prior art chair mat 1 of FIGS. 1A-1D being shown in phantom lines for added clarity. As shown in FIG. 2A, the chair mat 10 makes more efficient use of the surface area of the body 12, which is defined by the perimeter 14. As shown in FIG. 2B, the arcuate lip portion 18 is curved to accommodate the circular footprint of the base 3 of the office chair. As shown in FIG. 2C, as the base 3 moves near the rear linear portion 16 of the chair mat 10, the left and right rear arcuate portions 20, 22 accommodate the circular footprint of the base 3. Additionally, as shown in FIG. 2D, the left and right arcuate inwardly projecting portions 34, 36 allow for greater space for the wheels 4 to move around, decreasing the likelihood that a wheel 4 of the base 3 may unintentionally exit the chair mat 10. Having a wheel 4 exit the chair mat 1 is a common problem for prior art chair mats 1 having the rectangular lip portion 2 as discussed above with respect to FIGS. 1A-1D.

As shown, the left and right arcuate inwardly projecting portions 34, 36 have an increased radius R1 to improve functionality and improve surface area usage of the chair mat 10. The left and right arcuate inwardly projecting portions 34, 36 are not restricted by the narrow desk leg geometry of previous desk designs as described in the background section. Decreasing the radii R1 of the left and right arcuate inwardly projecting portions 34, 36 reduce the likelihood that a wheel 4 of the base 3 may roll off the chair mat 10. Having a wheel 4 that rolls off the chair mat 10 may potentially cause damage to the underlying floor surface (not shown) and/or may cause the easy rolling motion of the chair to become restricted.

As further shown in FIGS. 2A-3, the external radii R2 of the left and right rear arcuate portions 20, 22, the external radii R3 of the left and right front arcuate portions 24, 28, and/or the external radius R4 of the arcuate lip portion 18 are generally related to the diameter D of the base 3, and may be sized to match the prevalent diameter D of the base 3 in current chair designs, thereby maximizing the usable surface area of any chair mat 10 having the same total surface area. Generally, the diameter D of the base 3 of the chair is between 20 inches and 30 inches (with the a preferred diameter of the base 3 being 24 inches or 28 inches), which would result in a radius of between 10 inches and 15 inches for the base 3. While the left and right sides of the chair mat 10 are shown as being symmetrical, this is not required.

As a result, it is desirable that the radii R2 of the left and right rear arcuate portions 20, 22, and/or the external radius R4 of the arcuate lip portion 18 be between about 10 inches and about 15 inches to accommodate the 10 to 15 inch radius R of the base 3. It is also desirable that the left and right front arcuate portions 24, 28 have external radii R3 between about 5 inches and about 7.5 inches to accommodate as much as possible the 10 to 15 inch radius R of the base 3. Additionally, the internal radii R1 of the left and right arcuate inwardly projecting portions 34, 36 may vary with the width of the chair mat 10. Also, the arcuate lip portion 18 may extend beyond the left and right arcuate inwardly projecting portions 34, 36 by half of the radius R4 of the arcuate lip portion 18 and the radius R4 of the arcuate lip portion 18, respectively.

The indicated radii are based on a 12 inch radius R of the base 3, although a suitable range of radii R for the base 3 may be between about 10 inches to about 15 inches. For example, the 6 inch and 12 inch radii may be replaced by those having the same 1:2 ratio (for example a 5:10 ratio, 7:14 ratio and so on) or another suitable ratio. Also, the minimum lip and the maximum lip correspond to half of the radius R4 of the arcuate lip portion 18 and the radius R4 of the arcuate lip portion 18, respectively.

According to an exemplary embodiment, the arcuate lip portion 18 has an external radius R4 of 12 inches, the left and right rear arcuate portions 20, 22 have external radii R2 of 12 inches, the left and right front arcuate portions 24, 28 have external radii R3 of 6 inches, and the left and right arcuate inwardly projecting portions 34, 36 have internal radii R1 of 6 inches. Additionally, the arcuate lip portion 18 extends 6 inches beyond the left and right front arcuate portions 24, 28, with the arcuate lip portion 18 extending 12 inches beyond the left and right front arcuate portions 24, 28.

According to another exemplary embodiment, the arcuate lip portion 18 has an external radius R4 of 12 inches, the left and right rear arcuate portions 20, 22 have external radii R2 of 12 inches, the left and right front arcuate portions 24, 28 have external radii R3 of 12 inches, and the left and right arcuate inwardly projecting portions 34, 36 have internal radii R1 of 12 inches. Additionally, the arcuate lip portion 18 extends 6 inches beyond the left and right front arcuate portions 24, 28, with the arcuate lip portion 18 extending 12 inches beyond the left and right front arcuate portions 24, 28.

According to another exemplary embodiment, the arcuate lip portion 18 has an external radius R4 of 12 inches, the left and right rear arcuate portions 20, 22 have external radii R2 of 12 inches, the left and right front arcuate portions 24, 28 have external radii R3 of 6 inches, and the left and right arcuate inwardly projecting portions 34, 36 have internal radii R1 of 18 inches. Additionally, the arcuate lip portion 18 extends 6 inches beyond the left and right front arcuate portions 24, 28.

According to another exemplary embodiment, the arcuate lip portion 18 may have an external radius R4 of 12 inches, the left and right rear arcuate portions 20, 22 have external radii R2 of 12 inches, the left and right front arcuate portions 24, 28 have external radii R3 of 12 inches, the left and right arcuate inwardly projecting portions 34, 36 have internal radii R1 of 18 inches. Additionally, the arcuate lip portion 18 extends 6 inches beyond the left and right front arcuate portions 24, 28.

Figure 5:
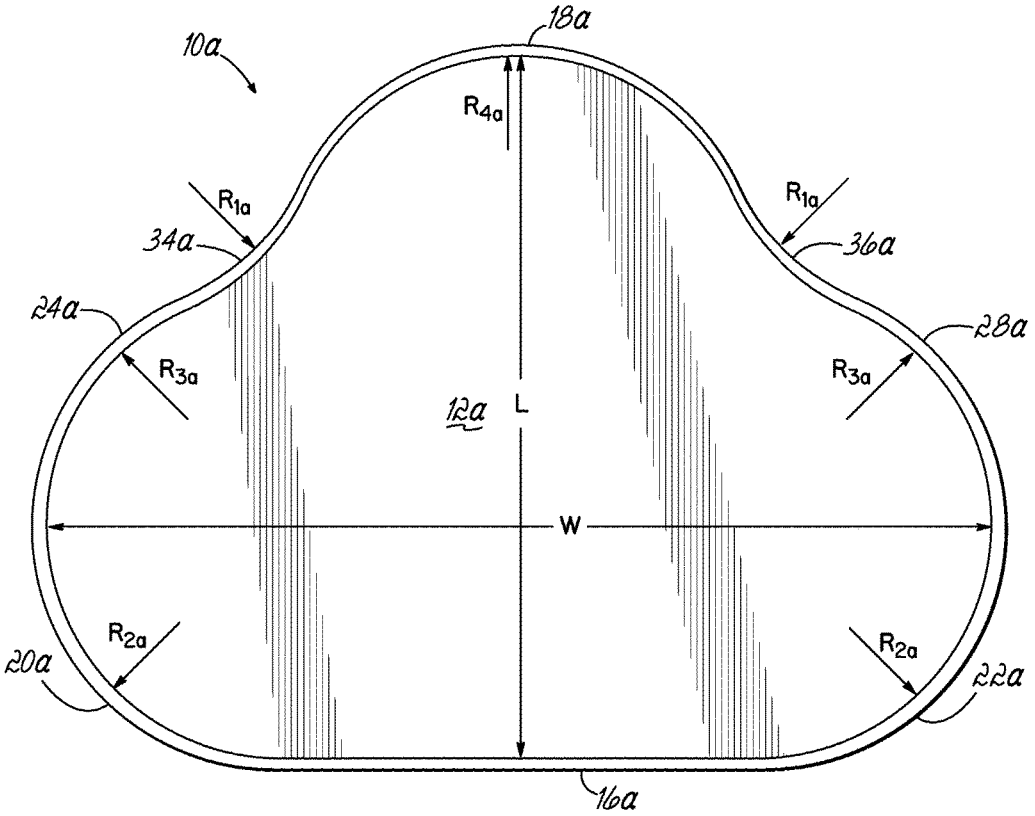
FIG. 5 is a top view of a chair mat according to an exemplary embodiment.
Figure 6:
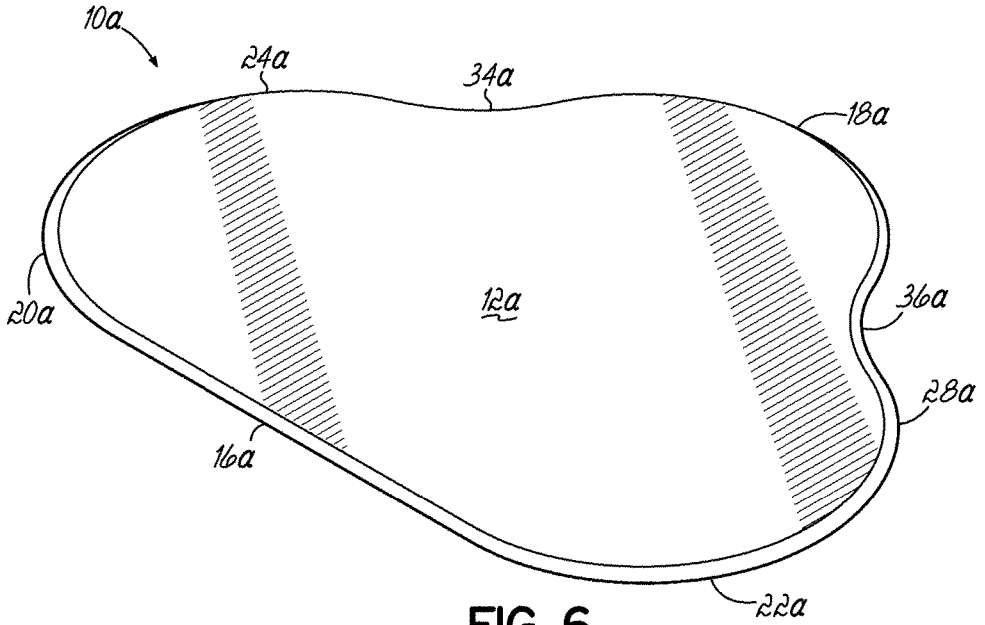
FIG. 6 is a perspective view of the chair mat of FIG. 5.

According to another exemplary embodiment shown in FIGS. 5 and 6, the arcuate lip portion 18*a* has a radius R4*a* of 12 inches. The left and right linear portions may be omitted in this embodiment. As a result, the left rear arcuate portion 20*a* is adjacent the left front arcuate portion 24*a*, while the right rear arcuate portion 22*a* is adjacent the right front arcuate portion 28*a* with each having radii R2*a*, R3*a* of 12 inches. Also, the left and right arcuate inwardly projecting portions 34*a*, 36*a* have internal radii R1 of 12 inches.

In various embodiments, the arcuate lip portion has an arcuate lip portion radius and the ratio of the chair base radius to the arcuate lip portion radius may be between about 1:1.5 and 1:1. Moreover, the left and right rear arcuate portions have left and right rear arcuate portion radii and the ratio of the chair base radius to the left and right rear arcuate portion radii may be between about 1:1.5 and 1:1. The left and right front arcuate portions have left and right front arcuate portion radii and the ratio of the chair base radius to the left and right front arcuate portion radii may be between about 1:3 and 1:1. The left and right arcuate inwardly projecting portions have an internal radius and the ratio of the chair base radius to the internal radius may be between about 1:2.5 and 1:1. In other embodiments, the arcuate lip portion has an arcuate lip portion radius which is generally equal to the chair base radius. In still another embodiment, the left and right rear arcuate portions each have a rear arcuate portion radius which is generally equal to the chair base radius. Further, the chair base radius may be between about 10 inches and about 15 inches. Moreover, the internal radius may be between about 6 inches and about 18 inches. Also, the ground engaging base may further comprise at least five wheels positioned in a circular pattern having a radius of between about 10 inches and about 15 inches.

While this invention has been illustrated by the description of one or more embodiments thereof, and while the embodiments have been described in considerable detail, they are not intended to restrict or in any way limit the scope of the appended claims to such detail. For example while various arcuate portions have been described as having radii, these various arcuate portions are not limited to radii, but rather include any curvilinear variation. The various features as described herein may be used in the described combinations or in any combination according to the needs of the user. Additional advantages and modifications will readily appear to those skilled in the art. The invention in its broader aspects is therefore not limited to the specific details, representative chair mat 10 and illustrative examples shown and described. Accordingly, departures may be from such details without departing from the scope or spirit of the general inventive concept.

What is claimed is:

1. A chair mat comprising:

a body having a perimeter defined at least in part by:

a rear linear portion disposed opposite an arcuate lip portion;

left and right rear arcuate portions separated by the rear linear portion;

a left front arcuate portion separated from the left rear arcuate portion by a left linear portion;

a right front arcuate portion separated from the right rear arcuate portion by a right linear portion;

a left arcuate inwardly projecting portion separating the left front arcuate portion and the arcuate lip portion; and a right arcuate inwardly projecting portion separating the right front arcuate portion and the arcuate lip portion, wherein the left and right arcuate inwardly projecting portions have an internal radius of between about 6 inches and about 18 inches.

2. The chair mat of claim 1:

wherein the left and right rear arcuate portions have external radii of between about 10 inches and about 15 inches, wherein the left and right front arcuate portions have external radii of between about 5 inches to about 7.5 inches, and wherein the front lip projection has an external radius of between about 10 inches to about 15 inches.

3. The chair mat of claim 1:

wherein the left and right rear arcuate portions have external radii of about 12 inches, wherein the left and right front arcuate portions have external radii of between about 6 inches and about 12 inches, and wherein the front lip projection has an external radius of about 12 inches.

4. The chair mat of claim 3, wherein the left and right arcuate inwardly projecting portions have an internal radius of between about 6 inches and about 12 inches.

5. The chair mat of claim 1, wherein the external radii of the left and right rear arcuate portions, the left and right front arcuate portions, and the front lip projection are configured to correspond to a radius of a base of a chair.

6. The chair mat of claim 1, wherein the perimeter includes a contoured edge.

7. A chair mat comprising:

a body having a perimeter defined by:

a rear linear portion disposed opposite an arcuate lip portion;

left and right rear arcuate portions separated by the rear linear portion;

left and right front arcuate portions;

a left arcuate inwardly projecting portion separating the left front arcuate portion and the arcuate lip portion; and a right arcuate inwardly projecting portion separating the right front arcuate portion and the arcuate lip portion, wherein the left and right arcuate inwardly projecting portions have an internal radius of between about 6 inches and about 18 inches.

8. The chair mat of claim 7, wherein the perimeter includes a contoured edge.

9. A combination comprising:

a chair including a ground engaging base having a chair base radius; and a chair mat having a body with a perimeter defined at least in part by:

a rear linear portion disposed opposite an arcuate lip portion;

left and right rear arcuate portions separated by the rear linear portion;

a left front arcuate portion separated from the left rear arcuate portion by a left linear portion;

a right front arcuate portion separated from the right rear arcuate portion by a right linear portion;

a left arcuate inwardly projecting portion separating the left front arcuate portion and the arcuate lip portion; and a right arcuate inwardly projecting portion separating the right front arcuate portion and the arcuate lip portion, wherein the arcuate lip portion has an arcuate lip portion radius and the ratio of the chair base radius to the arcuate lip portion radius is between about 1:1.5 and 1:1.

10. The combination of claim 9, wherein the left and right rear arcuate portions have left and right rear arcuate portion radii and the ratio of the chair base radius to the left and right rear arcuate portion radii are between about 1:1.5 and 1:1.

11. The combination of claim 10, wherein the left and right front arcuate portions have left and right front arcuate portion radii and the ratio of the chair base radius to the left and right front arcuate portion radii are between about 1:3 and 1:1.

12. The combination of claim 11, wherein the left and right arcuate inwardly projecting portions have an internal radius and the ratio of the chair base radius to the internal radius is between about 1:2.5 and 1:1.

13. The combination of claim 9, wherein the arcuate lip portion has an arcuate lip portion radius which is generally equal to the chair base radius.

14. The combination of claim 9, wherein the left and right rear arcuate portions each have a rear arcuate portion radius which is generally equal to the chair base radius.

15. The combination of claim 9, wherein the chair base radius is between about 10 inches and about 15 inches.

16. The combination of claim 9, wherein the internal radius is between about 6 inches and about 18 inches.

17. The combination of claim 9 wherein the ground engaging base further comprises at least five wheels positioned in a circular pattern having a radius of between about 10 inches and about 15 inches.

* * * * *